US010323483B2

(12) United States Patent
Scott et al.

(10) Patent No.: US 10,323,483 B2
(45) Date of Patent: Jun. 18, 2019

(54) MITIGATION OF HYDRATES, PARAFFINS AND WAXES IN WELL TOOLS

(71) Applicant: HALLIBURTON ENERGY SERVICES, INC., Houston, TX (US)

(72) Inventors: Bruce E. Scott, McKinney, TX (US); Thomas W. Swan, Parker, TX (US); John J. Goiffon, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 466 days.

(21) Appl. No.: 13/678,158

(22) Filed: Nov. 15, 2012

(65) Prior Publication Data

US 2013/0153230 A1 Jun. 20, 2013

(51) Int. Cl.
*E21B 37/00* (2006.01)
*E21B 34/10* (2006.01)
*E21B 36/00* (2006.01)

(52) U.S. Cl.
CPC ..... *E21B 37/00* (2013.01); *E21B 34/10* (2013.01); *E21B 36/005* (2013.01)

(58) Field of Classification Search
CPC ..... E21B 34/00; E21B 34/10; E21B 36/005; E21B 47/00; E21B 41/02; E21B 43/24; E21B 43/2401; E21B 36/04; E21B 36/00
USPC ..... 166/250.01, 250.05, 302, 304, 311, 57, 166/59, 60, 61, 65.1
See application file for complete search history.

(56) References Cited

U.S. PATENT DOCUMENTS 4,716,960 A * 1/1988 Eastlund et al. ..... 166/60
5,323,855 A * 6/1994 Evans ..... 166/248
6,112,808 A * 9/2000 Isted ..... 166/60
6,588,500 B2 * 7/2003 Lewis ..... 166/61
7,597,148 B2 * 10/2009 O'Malley et al. ..... 166/304
2005/0283276 A1 * 12/2005 Prescott et al. ..... 700/282
2005/0284659 A1 * 12/2005 Hall et al. ..... 175/27
2006/0048941 A1 3/2006 Borst et al.
(Continued)

FOREIGN PATENT DOCUMENTS

RU 2029069 C1 2/1995
RU 2140519 C1 10/1999
(Continued)

OTHER PUBLICATIONS

Office Action Russian Patent Application No. 2014127145/03(043862) dated Jan. 14, 2016.
(Continued)

*Primary Examiner* — George S Gray
(74) *Attorney, Agent, or Firm* — Locke Lord LLP; Daniel Nguyen; Joshua L. Jones

(57) ABSTRACT

A method of mitigating formation of an undesired accumulation of a substance in a well tool through which a well fluid flows can include heating a surrounding wall of an interior flow passage through which the well fluid flows. A system for of mitigating formation of an undesired accumulation of a substance in a well tool can include an interior flow passage having a surrounding wall, and a heater which heats the wall of the flow passage. Another method of mitigating formation of an undesired accumulation of a substance in a well tool can include monitoring the accumulation of the substance in the well tool, and heating a surrounding wall of an interior flow passage in response to detecting the accumulation.

6 Claims, 9 Drawing Sheets

(56) References Cited

U.S. PATENT DOCUMENTS

| | | | | |
|---|---|---|---|---|
| 2008/0236810 | A1 | 10/2008 | Bornes et al. | |
| 2009/0025931 | A1 | 1/2009 | Soni et al. | |
| 2009/0111715 | A1 | 4/2009 | Ballard et al. | |
| 2012/0068712 | A1* | 3/2012 | Taherian et al. | 324/338 |

FOREIGN PATENT DOCUMENTS

| | | | |
|---|---|---|---|
| RU | 2291281 | C1 | 1/2007 |
| WO | WO-2009051495 | A1 | 4/2009 |

OTHER PUBLICATIONS

Search Report dated Aug. 3, 2012 for International Application No. PCT/US11/64762, 5 pages.
Written Opinion dated Aug. 3, 2012 for International Application No. PCT/US11/64762, 4 pages.
International Search Report with Written Opinion dated Aug. 3, 2012 for PCT Patent Application No. PCT/US11/064762, 9 pages.

* cited by examiner

MITIGATION OF HYDRATES, PARAFFINS AND WAXES IN WELL TOOLS

CROSS-REFERENCE TO RELATED APPLICATION

This application claims the benefit under 35 USC § 119 of the filing date of International Application Serial No. PCT/US11/64762, filed 14 Dec. 2011. The entire disclosure of this prior application is incorporated herein by this reference.

BACKGROUND

This disclosure relates generally to operations performed and equipment utilized in conjunction with a subterranean well and, in one example described below, more particularly provides for mitigation of accumulation of undesired substances in a well tool.

To prevent formation of hydrates, waxes, paraffins and other undesired substances in well tools, the well tools can be positioned at or below a certain depth, with the temperature at that depth being greater than that at which the hydrates, etc. form. However, conditions change over time, and predicting the appropriate depth for certain well tools is an inexact science.

It will be appreciated that improvements are continually needed in the art of mitigating accumulation of undesired substances in downhole well tools.

SUMMARY

In this disclosure, systems and methods are provided which bring improvements to the art of preventing or reducing accumulation of precipitates, hydrates, waxes, paraffins, etc.). One example is described below in which a wall of a flow passage in a well tool is heated to mitigate the accumulation of the undesired substances. Another example is described below in which the wall is vibrated to mitigate the accumulation of the undesired substances.

In one aspect, a method of mitigating formation of an undesired accumulation of a substance in a well tool through which a well fluid flows is described below. In one example, the method can include heating a surrounding wall of an interior flow passage through which the well fluid flows.

In another aspect, a system for of mitigating formation of an undesired accumulation of a substance in a well tool is described. The system can, in one example, include an interior flow passage having a surrounding wall, and a heater which heats the wall of the flow passage.

In yet another aspect, a method of mitigating formation of an undesired accumulation of a substance in a well tool can include monitoring the accumulation of the substance in the well tool, and heating a surrounding wall of an interior flow passage in response to detecting the accumulation.

These and other features, advantages and benefits will become apparent to one of ordinary skill in the art upon careful consideration of the detailed description of representative embodiments of the disclosure herein, and the accompanying drawings, in which similar elements are indicated in the various figures using the same reference numbers.

DETAILED DESCRIPTION

Figure 1:
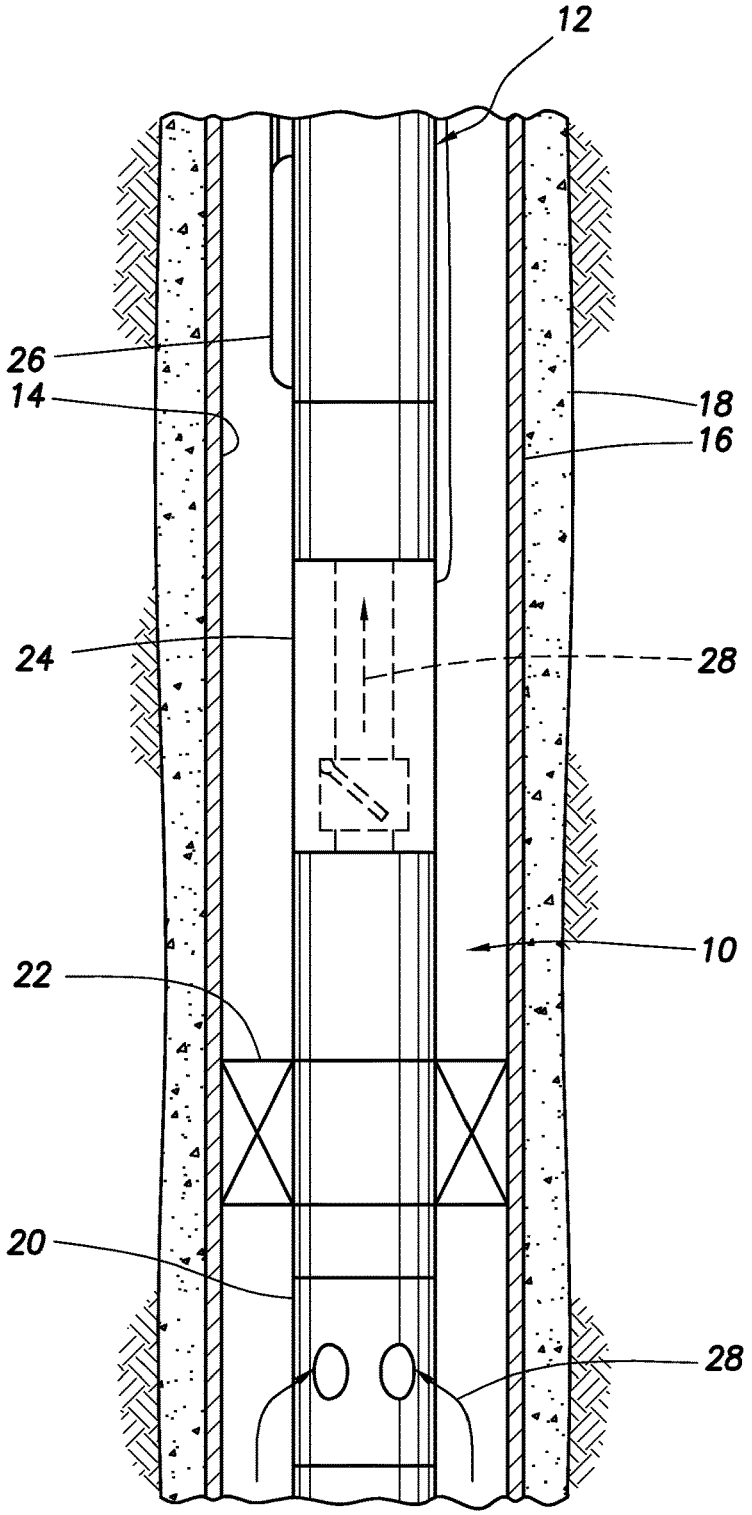
FIG. 1 is a representative partially cross-sectional view of a system and associated method which can embody principles of this disclosure.

Representatively illustrated in FIG. 1 is a system 10 and associated method which can embody principles of this disclosure. However, it should be clearly understood that the scope of this disclosure is not limited at all to the details of the system 10 and method described herein or depicted in the drawings, since a wide variety of different systems and methods can incorporate the principles of this disclosure.

In the FIG. 1 example, a production tubing string 12 is installed in a wellbore 14 lined with casing 16 and cement 18. Various well tools 20, 22, 24, 26 are interconnected in the tubing string 12.

The well tool 20 is a production flow control device (such as a valve or choke), the well tool 22 is a packer, the well tool 24 is a safety valve and the well tool 26 is a side pocket mandrel. These are merely a few examples of the types of well tools which can benefit from the principles of this disclosure. Any other types of well tools, or any other combination of well tools, can be used as desired.

In production operations, a well fluid 28 flows through the well tools 20, 22, 24, 26, for example, to produce the fluid to the earth's surface. Unfortunately, as the fluid 28 flows toward the surface, its temperature decreases and undesirable precipitates, hydrates, paraffins, waxes, etc. can accumulate in the well tools 20, 22, 24, 26. This can impede operation of the well tools 20, 22, 24, 26, and can even cause failure of the well tools, in addition to restricting flow of the valuable fluid 28 to the surface.

In one feature of the system 10 described more fully below, a wall of an interior flow passage can be heated to thereby prevent or at least reduce formation of the undesired accumulations of substances in the well tools 22, 24, 26, 28. Furthermore, in some examples, the interior flow passage can be vibrated and/or inductively heated to further mitigate the accumulations of undesired substances in the well tools 20, 22, 24, 26.

Figure 2:
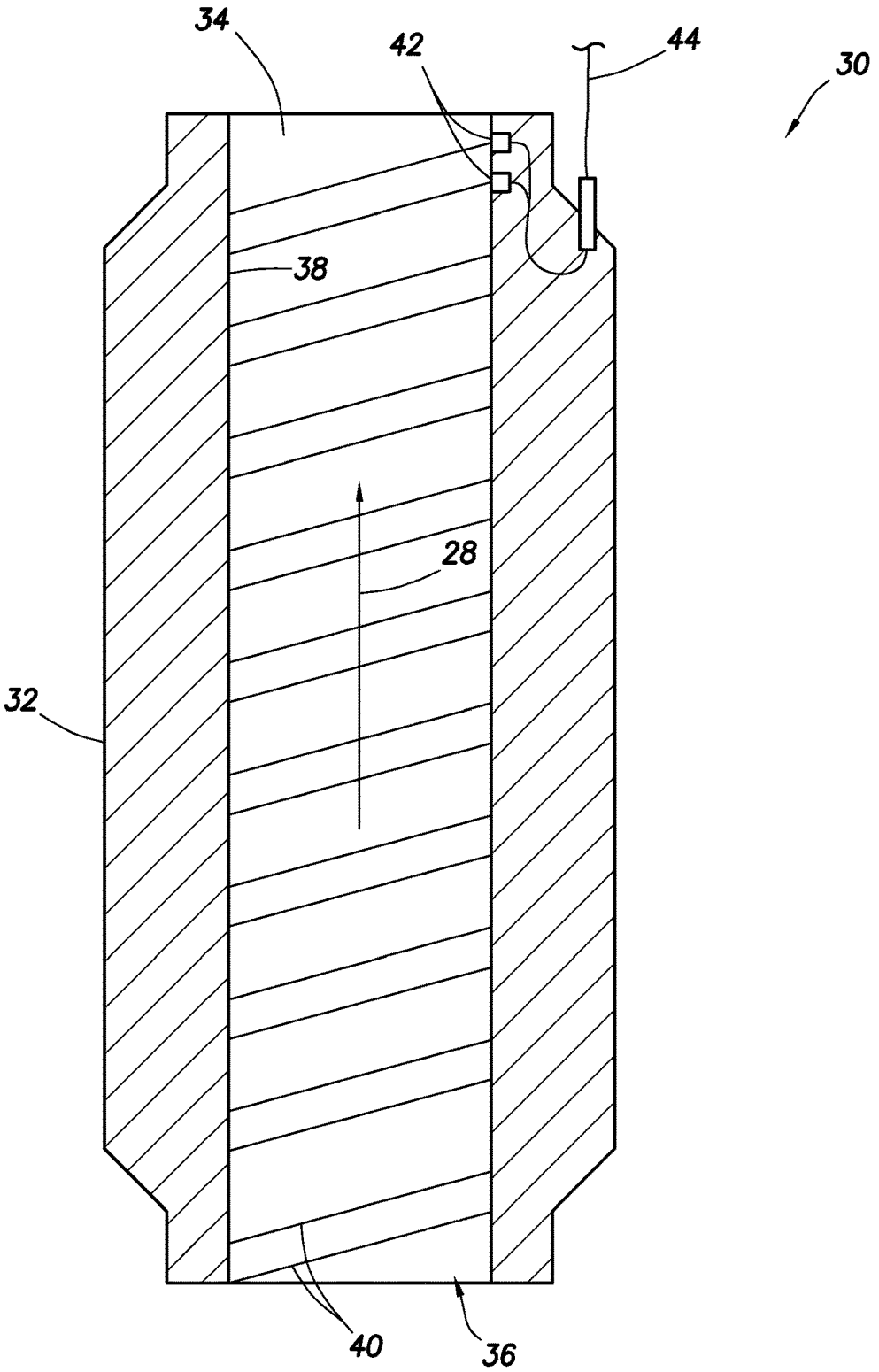
FIG. 2 is an enlarged scale representative cross-sectional view of a well tool which can embody principles of this disclosure, and which may be used in the system and method of FIG. 1.

Referring additionally now to FIG. 2, an enlarged scale cross-sectional view of a representative well tool 30 is schematically depicted. The well tool 30 may be used in the system 10 and method of FIG. 1, or it may be used in other systems and methods.

The well tool 30 could be any of the well tools 20, 22, 24, 26 described above, or any other type of well tool. The well tool 30 could be used in addition to any other well tools (such as the well tools 20, 22, 24, 26) in other systems and methods.

In the FIG. 2 example, the well tool 30 includes an outer housing 32 and an interior longitudinal flow passage 34 through which the fluid 28 flows. An electrical heater 36 comprises one or more conductors 40 adhered on a surrounding wall 38 of the flow passage 34.

The conductors 40 may be spirally wrapped as depicted in FIG. 2, or they may be in any other configuration. The conductors may be evenly, unevenly or randomly spaced.

The conductors 40 can comprise electrical resistance heating elements, inductive heating elements, etc.

Electrical contacts 42 in the housing 32 provide for connecting the conductors 40 to a line 44 extending to a remote location (such as, a control and power system at the earth's surface, a subsea location, a downhole generator, etc.). When electrical power is applied to the heater 36, the wall 38 of the flow passage 34 is heated, thereby preventing (or at least significantly reducing) the accumulation of undesired substances (e.g., precipitates, hydrates, waxes, paraffins, etc.) on the wall.

The conductors 40 may be attached in the flow passage 34 using any suitable technique. Adhesives (such as epoxies, etc.) may be used to adhere the conductors 40. In one example, the conductors 40 could be incorporated into a fiber (e.g., glass fiber, carbon fiber, KEVLAR™ fiber, etc.) and resin matrix composite material which forms the wall 38 of the flow passage 34.

No matter the technique used to attach the conductors 40 about the flow passage 34, preferably an interior surface of the wall 38 is left smooth, and with minimal dimensional changes. In this manner, adherence of the undesired substances to the wall 38 can be minimized. Note that the heater 36 comprises the surrounding wall 38 of the flow passage 34 in this example.

It can now be appreciated that it is not necessary for the bulk of the fluid 28 flowing through the flow passage 34 to be heated in the well tool 30 (although some of the fluid will be heated due to the heating of the wall 38). Instead, by heating the surrounding wall 38 of the passage 34, accumulation of the undesired substances on the wall is mitigated, without having to heat all or most of the fluid 28 itself.

In another feature of the system 10 described more fully below, the heating of the wall 38 can be controlled, so that the wall is heated when an accumulation of the undesired substance is detected, or when the accumulation exceeds a predetermined level. In this manner, the heater 36 can be de-energized when it is not needed, or a level of the electrical power (e.g., wattage, frequency, amplitude, voltage, etc.) supplied to the heater can be varied as appropriate for different levels of accumulation of the substance.

Figure 3:
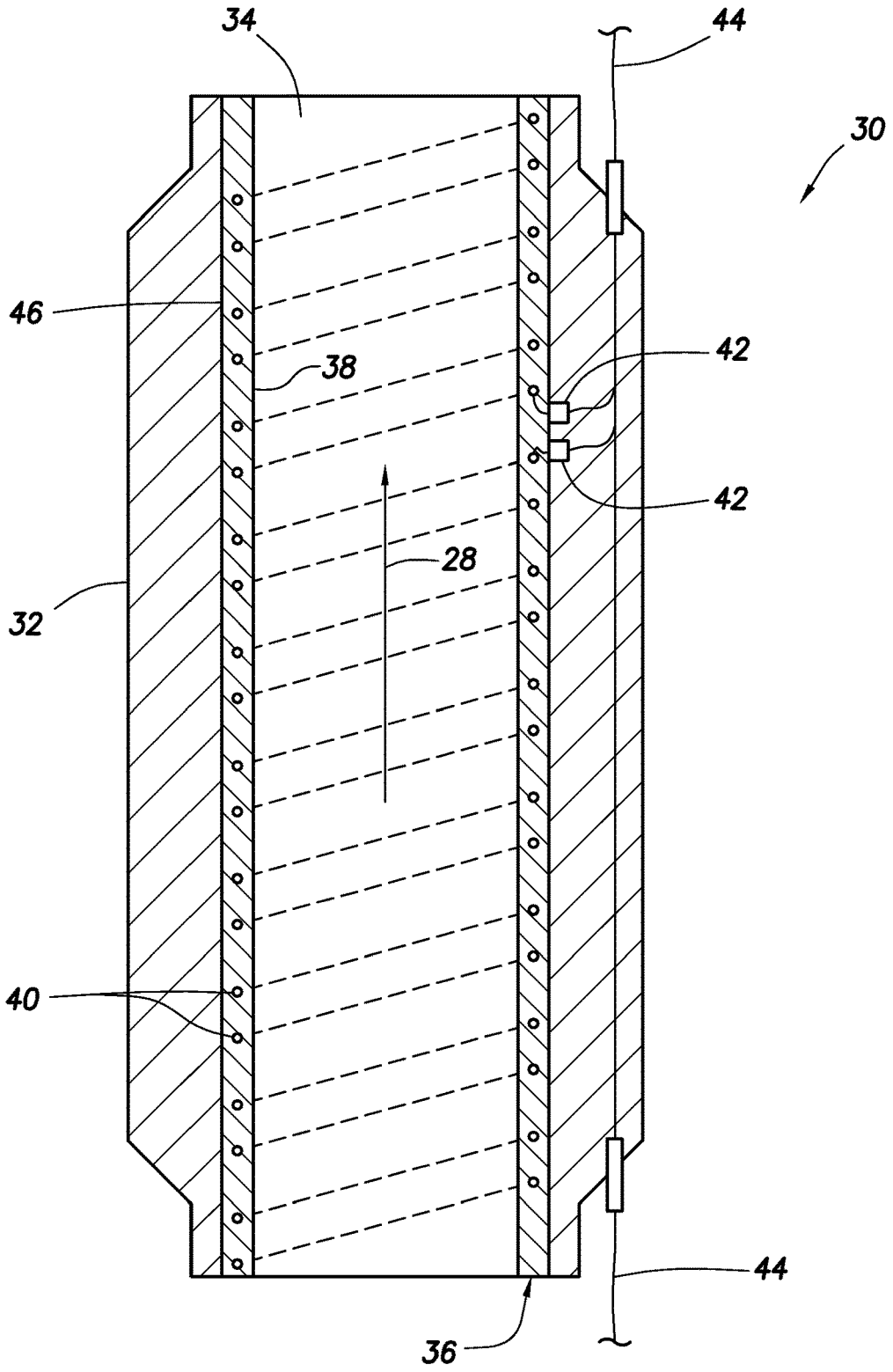
FIG. 3 is a representative cross-sectional view of another example of the well tool.

Referring additionally now to FIG. 3, another example of the well tool 30 is representatively illustrated. In this example, the heater 36 is separately installed in the well tool 30.

As depicted in FIG. 3, the heater 36 can comprise a sleeve insert 46 having the conductors 40 therein. For example, the conductors 40 could be embedded in a composite material of the sleeve insert 46, etc.

The insert 46 can be installed in the housing 32 when the well tool 30 is manufactured, the well tool could be retrofitted with the heater 36, or the insert could be installed in the housing after the well tool is installed in the wellbore 14 (e.g., using a running tool conveyed by slickline, wireline, coiled tubing, etc.).

Multiple well tools 30 can be interconnected in the tubing string 12 by extending the line 44 in both longitudinal directions from the well tool. If other electrically-operated tools (such as, an electric safety valve, an electric submersible pump, etc.) are in the tubing string 12, the well tool 30 can be interconnected in the line 44 between the power source and the other electrically-operated tool(s).

Figure 4:
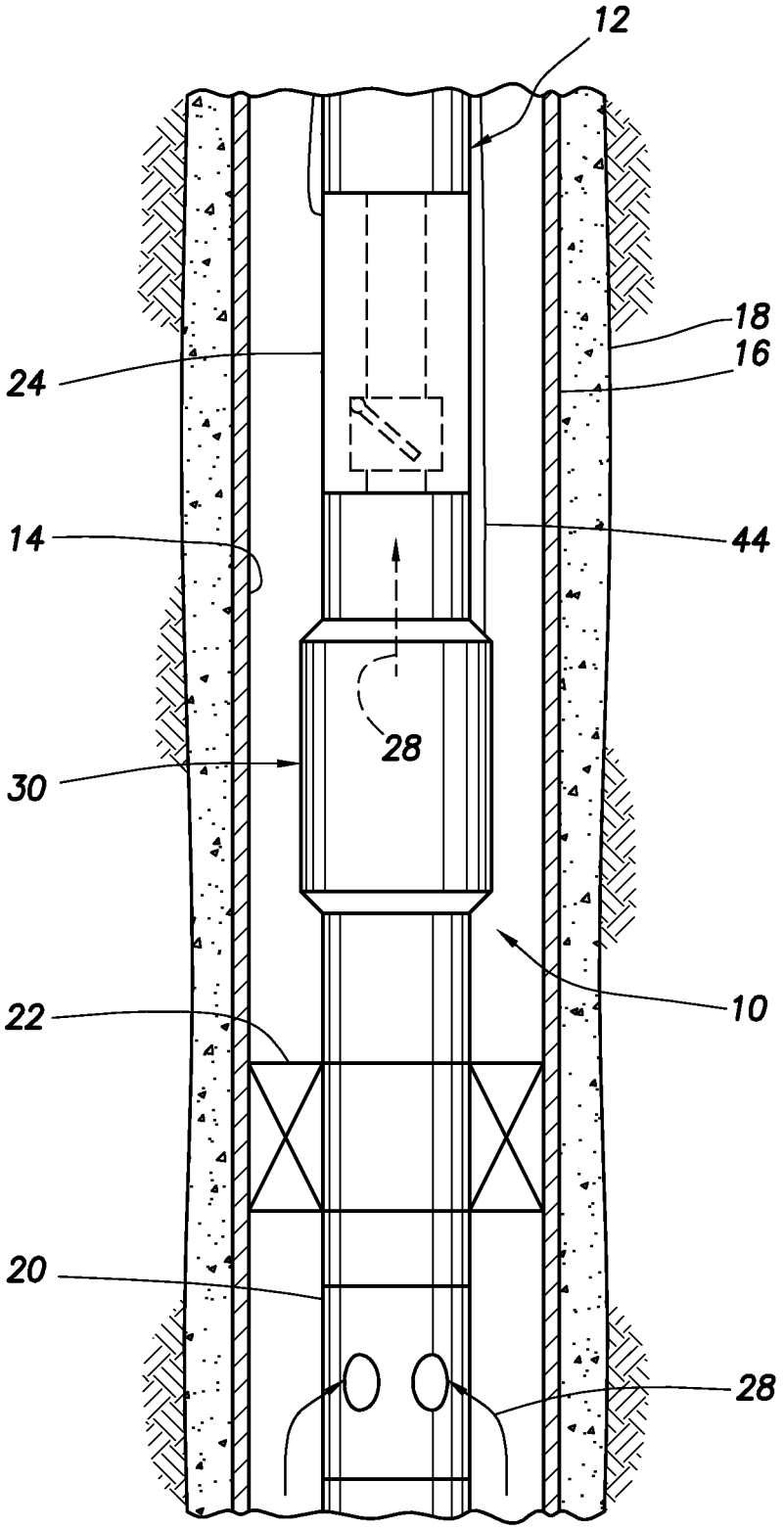
FIG. 4 is representative partially cross-sectional view of another example of the system and method.

Referring additionally now to FIG. 4, another example of the system 10 and method is representatively illustrated. In this example, the well tool 30 is interconnected in the tubing string 12 upstream of the well tool 24.

As mentioned above, the heating of the wall 38 can also heat the fluid 28 which is adjacent the wall. This effect can be used to mitigate the accumulation of the undesired substances in a well tool (such as the well tool 24 in the FIG. 4 example) which is downstream of the well tool 30.

If the well tool 24 comprises an electrically-operated safety valve, the line 44 can be used for operation of the well tool 24, as well as for operation of the well tool 30. In other examples, the well tool 30 can be connected upstream of well tools other than safety valves (e.g., nipples, other flow control devices, etc.).

Figure 5:
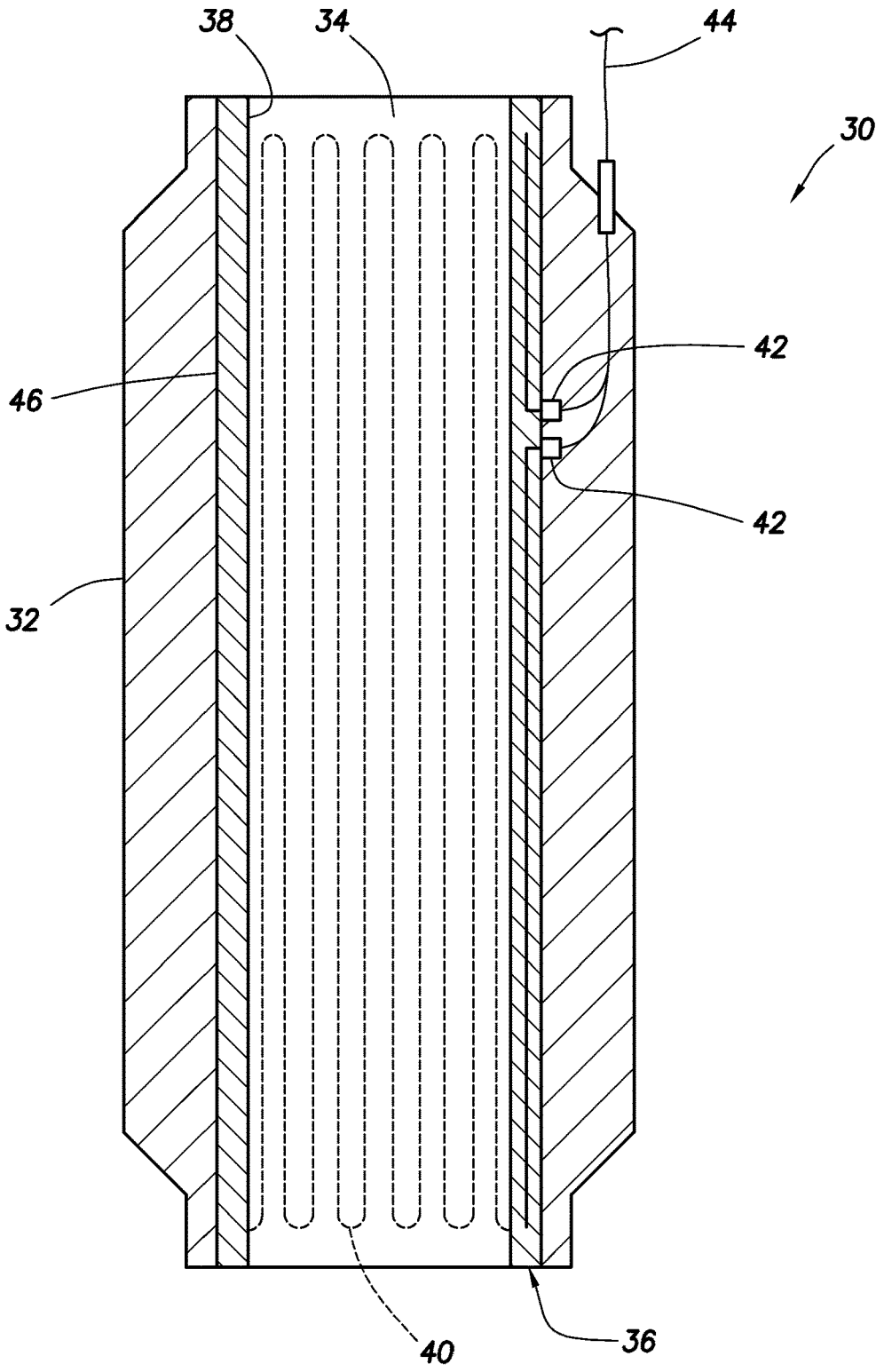
FIGS. 5-9 are representative cross-sectional views of additional examples of the well tool.

Referring additionally now to FIG. 5, another example of the well tool 30 is representatively illustrated. In this example, a single conductor 40 extends alternately upward and downward longitudinally in the sleeve insert 46. This demonstrates that a variety of different configurations of conductors 40 may be used, in keeping with the principles of this disclosure.

Figure 6:
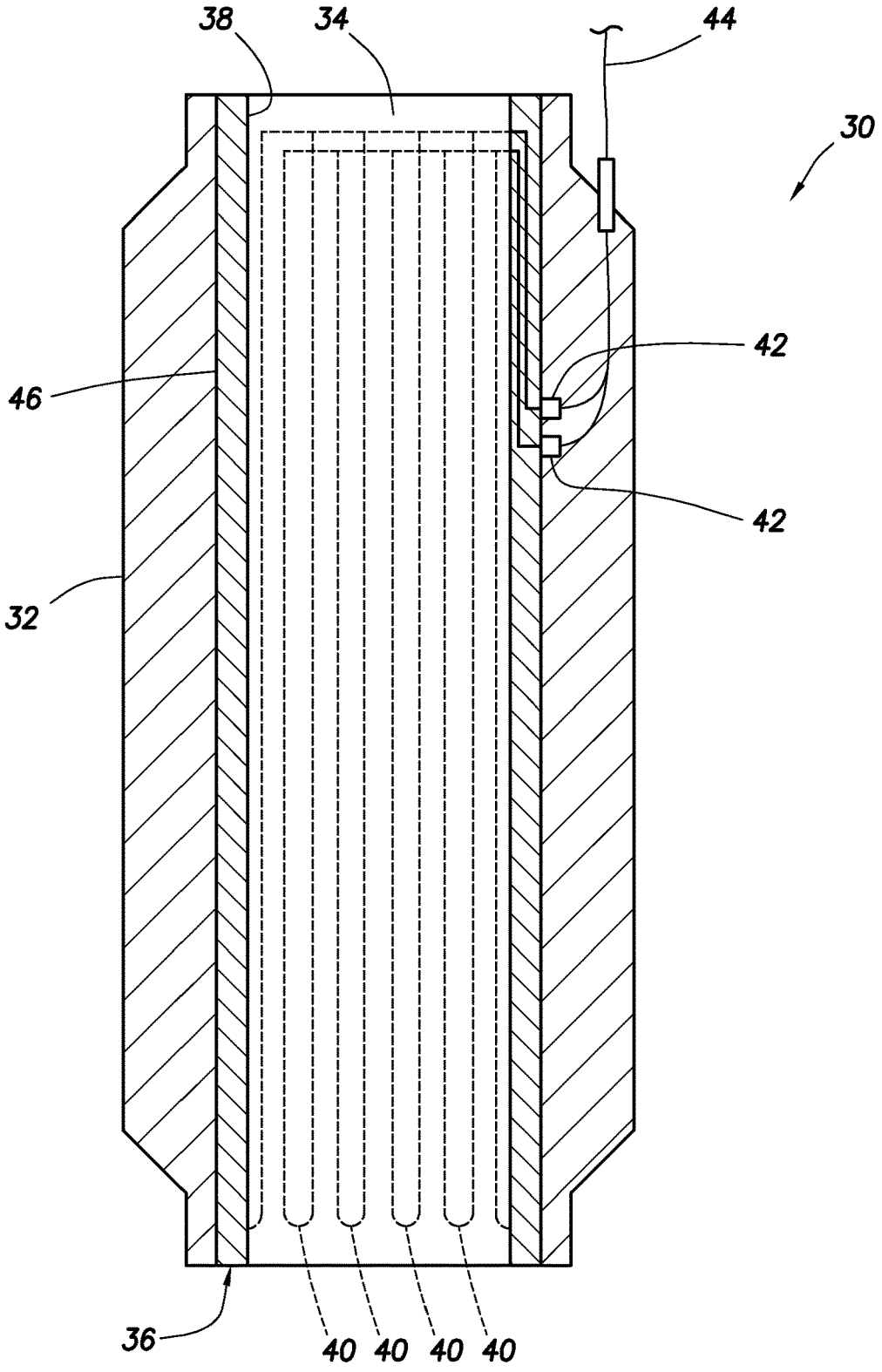

Referring additionally now to FIG. 6, another example of the well tool 30 is representatively illustrated. In this example, multiple conductors 40 are connected in parallel, with each of the conductors extending upward and downward longitudinally in the sleeve insert 46. This demonstrates that a variety of different numbers and arrangements of the conductors 40 may be used, in keeping with the principles of this disclosure.

Figure 7:
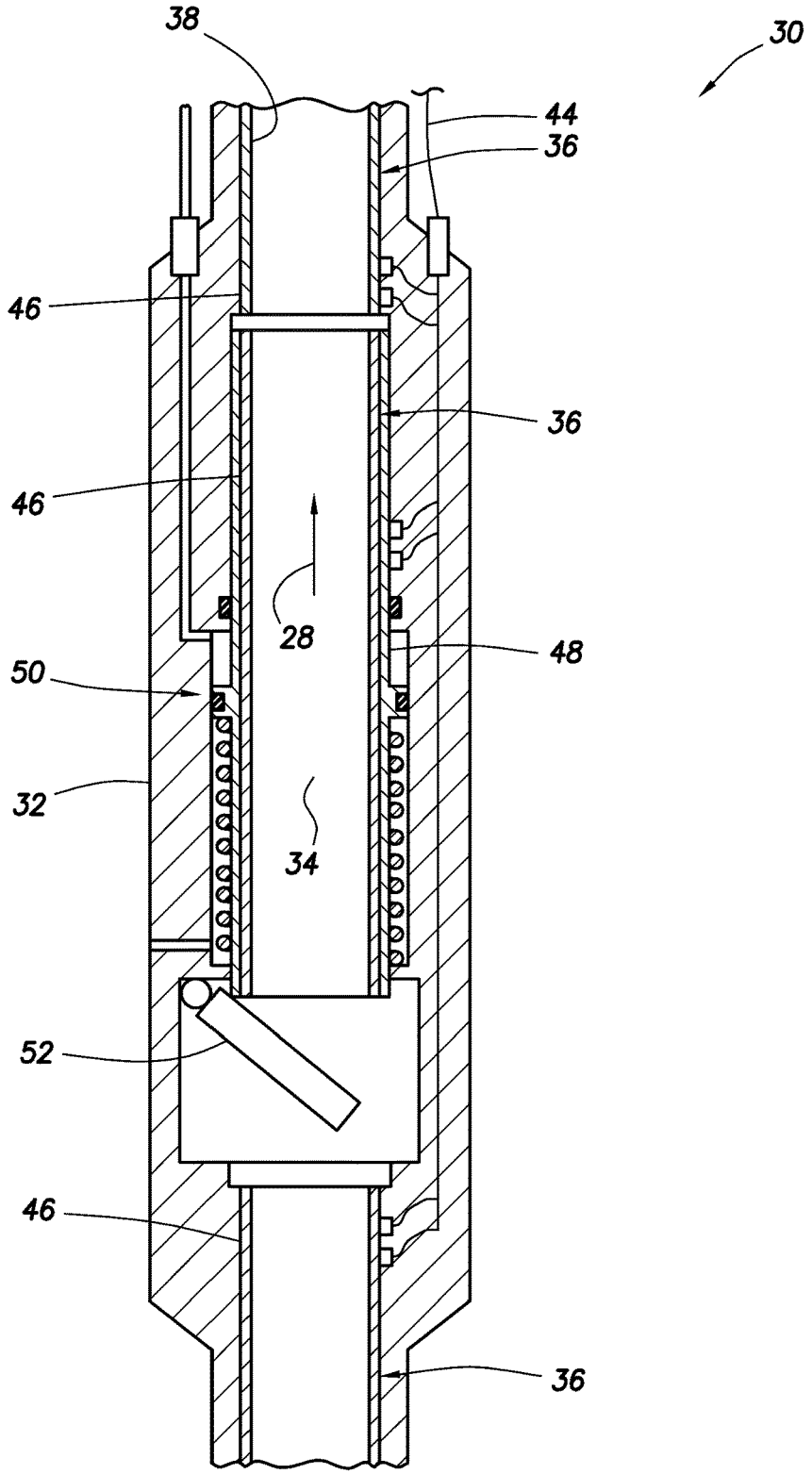

Referring additionally now to FIG. 7, another example of the well tool 30 is representatively illustrated. In this example, the well tool 30 comprises a safety valve (such as the well tool 24 in the system 10 of FIG. 1).

An operating member 48 (such as an opening prong or flow tube, etc.) is displaced by an actuator 50 (such as, a hydraulic or electrical actuator, etc.) to thereby open or close a closure member 52. In its closed position, the closure member 52 prevents flow of the fluid 28 through the passage 34 to thereby avoid inadvertent escape of fluid 28 from the well.

In the FIG. 7 example, multiple heaters 36 are used in the well tool 30 to mitigate formation of any accumulation of undesired substances on the surrounding wall 38 of the flow passage 34. One heater 36 extends about an upper section of the flow passage 34, another heater is positioned in the operating member 48, and yet another heater extends about a lower section of the flow passage. Any number and/or positions of the heaters 36 may be used, as desired.

Note that, although the operating member 48 displaces during operation of the well tool 30, the heater 36 can still mitigate accumulation of the undesired substances on the wall 38 in the operating member. In another example, a heater 36 could be attached to the closure member 52, or to any other member of the well tool 30 which displaces during operation of the well tool.

If the safety valve is electrically actuated (e.g., via an electric motor, an electrical linear actuator, etc.), the electrical power supply which is used to actuate the safety valve can also be used to operate the heaters 36. A suitable electrically actuated safety valve is described in U.S. application Ser. No. 13/196,565 filed on 2 Aug. 2011, the entire disclosure of which is incorporated herein by this reference.

Figure 8:
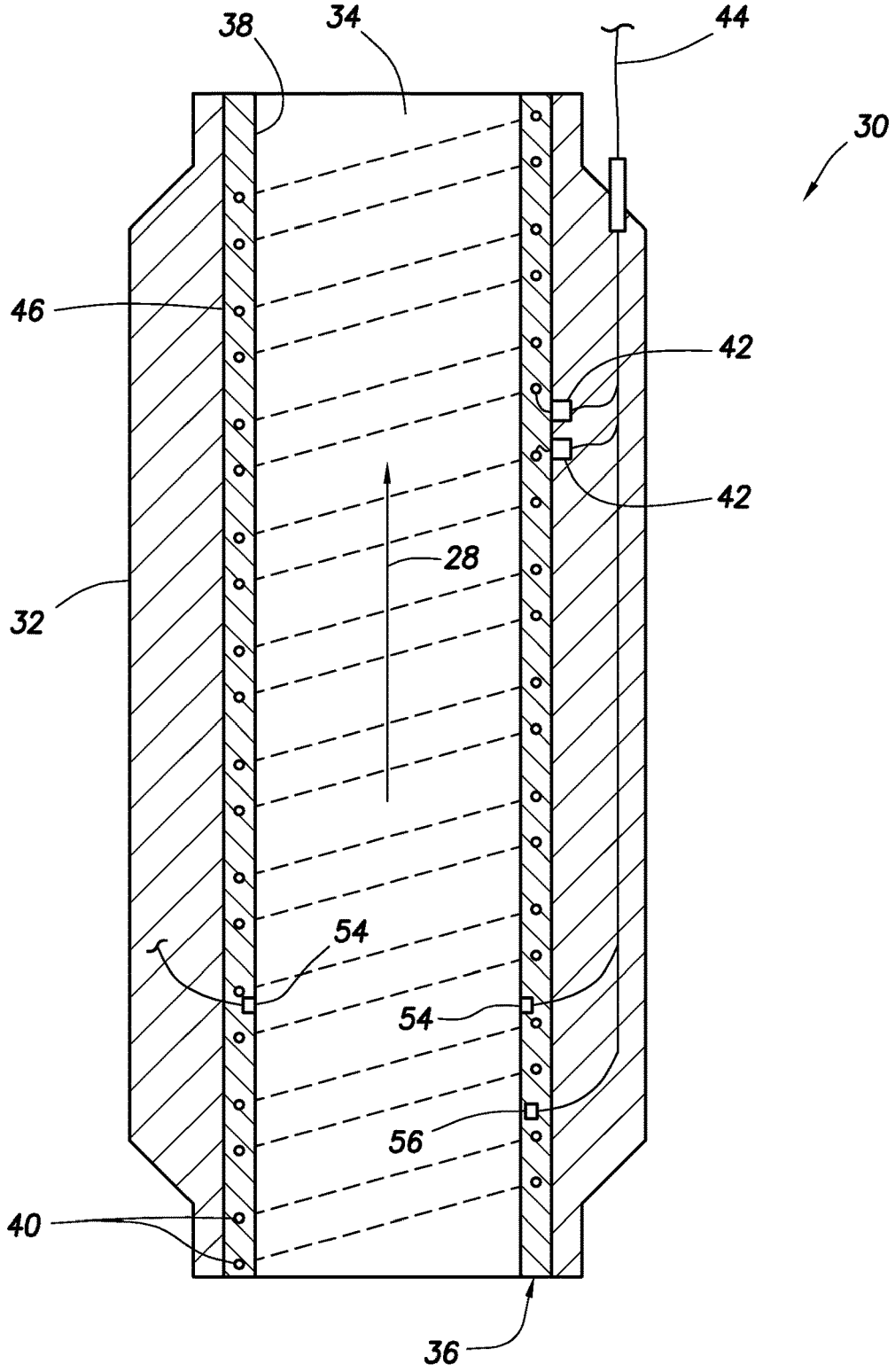

Referring additionally now to FIG. 8, another example of the well tool 30 is representatively illustrated. In this example, sensors 54 can be used to detect the presence and/or extent of accumulation of the undesired substances on the wall 38.

For example, the sensors 54 could comprise resistivity sensors which detect a change in resistivity due to the accumulation of the undesired substances. Resistivity could be measured across the flow passage 34, between different components of the well tool 30, between different locations on the same component, etc.

In other examples, the sensors 54 could comprise capacitive or inductive sensors. Changes in capacitance or inductance can indicate a change in wall thickness, which would occur if unwanted deposits are forming on the wall 38. Resistivity measurements can be augmented with capacitance and/or inductance measurements for enhanced accuracy in detecting accumulation of undesired substances on the wall 38.

In addition, a pressure and/or temperature sensor 56 can be used to detect conditions conducive to formation of the undesired substances on the wall 38. The heater 36 can be controlled, based on the conditions, parameters, etc. monitored by the sensors 54, 56.

Any type(s) of sensors may be used for the sensors 54, 56 in keeping with the principles of this disclosure. Any number, positions and/or configuration of sensors may be used, as desired.

Figure 9:
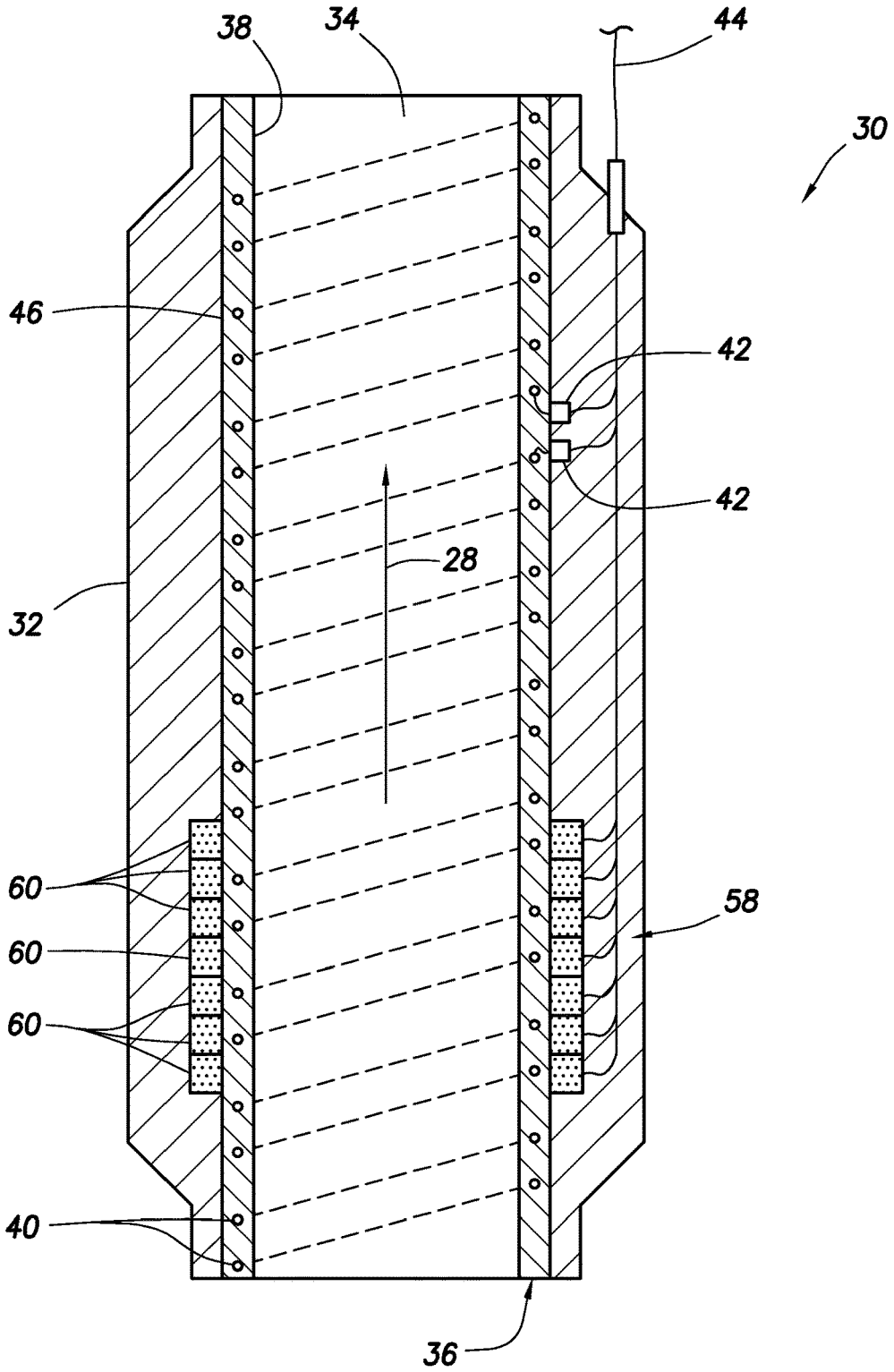

Referring additionally now to FIG. 9, another example of the well tool 30 is representatively illustrated. In this example, the wall 38 can be vibrated to further reduce accumulation of the undesired substances on the wall.

The well tool 30 includes a vibrator 58 which, in this example, comprises a stack of annular piezoelectric elements 60 encircling the sleeve insert 46. The piezoelectric elements 60 are energized as appropriate to cause vibration of the sleeve insert 46 and wall 38, thereby dislodging or preventing accumulation of undesired substances on the wall.

If the conductors 40 comprise one or more inductive heating elements, such inductive heating elements can also be used to induce vibration of the wall 38. Thus, it is not necessary for the vibrator 58 to be separate from the heater 36.

It may now be fully appreciated that this disclosure provides significant advancements to the art of mitigating accumulation of undesired substances in well tools.

In various examples described above, the well tool can have an electric line running from the surface (e.g., from a wellhead) to the well tool. This electric line can provide electrical power to a heating element that is either installed in or is an integral part of the tool.

The heating element can be installed as a sleeve insert type device that is fitted in the interior of the tool after normal manufacture of the tool. The well tool can have electrical contacts that connect the tool to the inserted heating element. Any number of contacts may be used.

The heating element can be an integral part of the tool. An example of this is a wire wrap or spiral configuration (e.g., a coil that is applied to the interior of the tool components during the manufacturing process). The wires of the heating element could be evenly spaced, unevenly spaced, or randomly spaced or have multiple spiral sections depending on the desired heating effects.

The heating element can be a component of a separate well tool that is run directly upstream of another well tool being protected, to impart a temperature increase to the flowing well fluid. This configuration would accommodate any length of heating element(s), without affecting the design of the protected well tool. The well tool with the heating element could be powered independently or in conjunction with power supplied to the protected well tool.

The heating element can extend longitudinally (e.g., parallel to a longitudinal axis of the well tool) instead of in a circular or spiral fashion. If longitudinally extending, the heating element could comprise a single continuous element or multiple elements.

Any manner of affixing the heating elements to the interior of the well tool may be used. The heating element(s) can be applied as an individual wire, multiple wires, embedded in a tape, etc. In one example, the application process can be a painting-type process where the heating elements are applied at the same time as an adhesive.

The heating element and/or adhesive can be made of a relatively short lived material if the life of the feature is not critical. Alternatively, the heating element and/or adhesive can be made of a more durable material (e.g., ceramic, abrasion resistant epoxy, etc.) if the life of the feature is critical.

The heating element can be powered continuously or it can be powered as needed. Controls to operate the heating element can be located within the well tool, near the tool, in another device, or at or above the surface (e.g., a wellhead, platform, control room, etc.).

As some well tools have internal features that move (e.g., sliding sleeve inserts, flow tubes, etc.) these features can also benefit from prevention of accumulation of undesired substances, and can have similar heating elements provided. A dynamic contact feature can be included that allows continuous contact between the heating element of the moving feature and the power source, or a fixed contact can be included so that the heating element of the moving feature only makes contact at a fixed point or fixed points.

As it may not be necessary, beneficial or practical to continuously power the heating element, a sensor that measures accumulation of undesired substances can be included in the well tool. For example, one or more sensors that measure resistance between two points, between the well tool and the fluid 28 flow, two points on the wall 38, etc.

A change in resistance can indicate the onset of accumulation. However, resistance is not necessarily the indicator of accumulation, or the only indicator of accumulation. Other indicators could include changes in other parameters or combinations of parameters (such as, capacitance, pH, inductance, heat capacity, etc.).

Other sensors (e.g., pressure and temperature sensors) can be included as part of the system 10. Temperature sensors can be particularly useful for ascertaining information on the performance and effectiveness of the system 10. Any number, type or combination of sensors may be used.

The well tool can be designed so that when the system 10 is energized the entire heating element of the tool is powered, or it can be designed so that only selected areas or components of the tool receive the heating. Whether the system 10 comprises a single heating element or multiple heating elements, the heating element(s) can be operated together or independently.

The composition of the adhesive or internal lining of the heater 36 and/or well tool 30 is also important. The wall 38 of the flow passage 34 is preferably configured so as to prevent or hinder the adhesion of precipitates, hydrates, waxes or paraffin. This can be accomplished, for example, by the adhesive or heating element having a smooth surface finish with minimal imperfections, or being made of a substance that has enhanced lubricity.

An electrical connection at the well tool can include a feed-thru connection that will allow the electric lines of other tools to be connected. This will allow multiple tools or valves to be powered by the same electric line and power sources. This also reduces the number of lines that pass through the wellhead and/or tubing hanger, and that need to be run downhole. Circuitry can be included that will protect the system 10 from failures of other devices that are attached electrically to the system.

The heater 36 can be a standalone electrical feature of the tool or it can be included as part of a tool that has other electrically operated components (e.g., an electric actuator of an electrically operated safety valve). If included as part of a tool that has other electrically operated components, the tool can include a feature that splits the power at the tool, providing one input source for the tool, but multiple outputs to the electrically operated features (e.g., the heating elements, actuator, sensors, etc.).

The system 10 can be powered by direct current (DC) power or alternating current (AC) power. The AC power can be of varying frequency to optimize the power throughput of the electrical lines, and to optimize the heat control over time.

AC power would also allow the use of inductive heating when appropriate. Inductive heating elements may also be constructed to vibrate, which would set up vibrations of the wall of the flow passage, allowing the undesired substances to be flowed out of the tool. Heating elements can be combined with piezoelectric elements to vibrate the undesired substances loose after or during heating.

A method is described above for mitigating formation of an undesired accumulation of a substance in a well tool 20, 22, 24, 26, 30 through which a well fluid 28 flows. In one example, the method includes heating a surrounding wall 38 of an interior flow passage 34 through which the well fluid 28 flows.

The method can also include monitoring the accumulation of the substance in the flow passage 34. The heating may be performed in response to the monitoring including detecting the accumulation, and/or detecting the accumulation being greater than a predetermined level.

The monitoring may be performed by at least one sensor 54, 56. The sensor 54 can comprise a resistivity sensor, a capacitance sensor, and/or an inductance sensor.

The heating can comprise incorporating a heater 36 about the flow passage 34. The incorporating may include adhering the heater 36 to an interior of the flow passage 34, and/or separately installing the heater 36 into an interior of the flow passage 34.

The heater 36 may displace during operation of the well tool 30. The incorporating can include attaching the heater 36 to a member 48, 52 of the well tool 30 which displaces during operation of the well tool 30.

The incorporating may be performed after installing the well tool 30 in a well. The incorporating may include electrically engaging the heater 36 with an electrical line 44 connected to the well tool 30 and extending to a remote location.

The heating can be performed by supplying electrical power to one or more electrical conductors 40 adhered to an interior of the well tool 34, and/or by supplying electrical power to one or more electrical conductors 40 in an insert 46 secured in the well tool 30 after the well tool 30 has been installed in a well.

The heating can include inductively heating the wall 38 of the flow passage 34.

The method can include vibrating the wall 38 of the flow passage 34. The vibrating may include energizing a stack of piezoelectric elements 60.

The well tool 30 may comprise a safety valve. The safety valve can be electrically actuated.

The well tool 30 may comprise an actuator 50. The actuator 50 may be electrically operated.

A system 10 for mitigating formation of an undesired accumulation of a substance in a well tool 20, 22, 24, 26, is also described above. In one example, the system 10 comprises an interior flow passage 34 having a surrounding wall 38, and a heater 36 which heats the wall 38 of the flow passage 34.

Also described above is a method of mitigating formation of an undesired accumulation of a substance in a well tool, which method includes monitoring the accumulation of the substance in the well tool 30, and heating a surrounding wall 38 of an interior flow passage 34 in response to the monitoring including detecting the accumulation.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A method of mitigating formation of an undesired accumulation of a substance in a well tool through which a well fluid flows, the method comprising:

heating a surrounding wall of an interior flow passage of the well tool through which the well fluid flows, wherein the heating comprises incorporating a heating element in a member of the well tool which displaces relative to an outer housing of the well tool during operation of the well tool, and wherein the heating element emits heat, thereby heating the surrounding wall.

2. The method of claim 1, wherein the incorporating comprises adhering the heater to an interior of the flow passage.

3. The method of claim 1, wherein the incorporating comprises separately installing the heater into an interior of the flow passage.

4. The method of claim 1, wherein the heater displaces during operation of the well tool.

5. The method of claim 1, wherein the incorporating is performed after installing the well tool in a well.

6. The method of claim 5, wherein the incorporating further comprises electrically engaging the heater with an electrical line connected to the well tool and extending to a remote location.

* * * * *